US006171220B1

(12) United States Patent
Lumpkin

(10) Patent No.: US 6,171,220 B1
(45) Date of Patent: Jan. 9, 2001

(54) FREE-WEIGHT EXERCISE APPARATUS AND METHOD

(76) Inventor: Sean F. Lumpkin, 5317 Wooddale Ave., Edina, MN (US) 55424

( * ) Notice: Under 35 U.S.C. 154(b), the term of this patent shall be extended for 0 days.

(21) Appl. No.: 09/089,537

(22) Filed: Jun. 3, 1998

(51) Int. Cl.[7] ..... A63B 21/065
(52) U.S. Cl. ..... 482/105
(58) Field of Search ..... 482/93, 105, 189; 224/625, 626, 262

(56) References Cited

U.S. PATENT DOCUMENTS 4,046,296 * 9/1977 McGhee ..... 224/262
4,911,434 * 3/1990 Herring ..... 482/105
4,984,786 * 1/1991 Lemke ..... 482/105

* cited by examiner

*Primary Examiner*—John Mulcahy
(74) *Attorney, Agent, or Firm*—Kinney & Lange, P.A.

(57) ABSTRACT

An apparatus for arranging a free-weight for exercise. A first band of pliable material is constructed into a loop and has a width that permits threading the loop through an opening in the free-weight thereby forming a first loop portion adjacent to the first side of the free-weight and a second loop portion adjacent to the second side of the free-weight. A second band of pliable material has a first end and a second end. The first end is attached to the first band of material and arranged to be attached to the first loop portion of the first band of material. A receiving member is attached to the second loop portion of the first band of material and arranged for attachment to the second end of the second band of material.

11 Claims, 4 Drawing Sheets

FREE-WEIGHT EXERCISE APPARATUS AND METHOD

BACKGROUND

The present invention generally relates to exercise equipment, and more particularly, to a free-weight exercise method and apparatus.

The importance of exercise in general has become widely known in recent years. A large portion of the population is engaging in various forms of exercise. One popular form of exercise is that performed with free-weights. Free-weights generally include dumbbells and barbells which are then manipulated without any type of machine assistance. Disk shaped platters of varying sizes and weights are used in combination with a bar as a barbell. Each disk has an opening in its center through which the bar is inserted.

Conventional and widely known free-weight exercises are generally sufficient for the majority of people who do not seriously compete in physical competitions, such as sporting events and body building. However, for those that do compete, maximum benefit is sought from each and every exercise. New exercises continue to be invented in an effort to focus on various muscles and to gain a competitive advantage.

Oftentimes, a new exercise requires a new apparatus for convenience and to accommodate various skill levels. Furthermore, known exercises can be practiced more effectively and conveniently with new apparatus. The present invention is directed to such an apparatus and method for its use.

SUMMARY

The present invention is directed to an apparatus and method for free-weight exercise. In one embodiment, the apparatus comprises: a first band of pliable material that is constructed into a loop. The first band has a width that permits threading the loop through the opening of a free-weight thereby forming a first loop portion adjacent to the first side of the free-weight and a second loop portion adjacent to the second side of the free-weight. The apparatus comprises in addition, a second band of pliable material having a first end and a second end. The first end is attached to the first band of material and arranged to be attached to the first loop portion of the first band of material. A receiving member is attached to the second loop portion of the first band of material and arranged for attachment to the second end of the second band of material.

In another embodiment, the apparatus comprises a first band of pliable material constructed into a first loop, the first band having a width that permits threading the formed loop through the opening of the free-weight thereby forming a first loop portion adjacent to the first side of the free-weight and a second loop portion adjacent to the second side of the free-weight; a second band of pliable material having a first end and a second end, the first end movably attached to the first band of material and arranged to be positioned on the first loop portion of the first band of material; and means for attaching the second end of the second band to the second loop portion of the first band of material.

An apparatus of yet another embodiment comprises a first band of pliable material constructed into a first loop, the first band having a width that permits threading the formed loop through the opening of the free-weight thereby forming a first loop portion adjacent to the first side of the free-weight and a second loop portion adjacent to the second side of the free-weight; a second band of pliable material having a first end and a second end, the first end formed into a loop around the first band and arranged to be positioned on the first loop portion; and means for attaching the second end of the second band to the second loop portion of the first band of material.

Another example apparatus comprises a first band of pliable material constructed with a first loop at a first end and a second loop at a second end, the first band having a width that permits threading the first loop through the opening of the free-weight; a second band of pliable material having a first end and a second end, the first end formed into a loop around the first band at the first loop; and means for attaching the second end of the second band to the second loop of the first band of material.

In accordance with the invention, an example method is provided for securing a free-weight to a person's feet for exercising therewith using a first band of pliable material constructed into a loop, a second band of pliable material having a first end attached to the first band of material and a second end. The method comprises: threading the loop through the opening of the free-weight thereby forming a first loop portion adjacent to the first side of the free-weight and a second loop portion adjacent to the second side of the free-weight; placing one foot into the first loop portion and the other foot into the second loop portion; wrapping the second band around the back of the person's feet; and attaching the second end of the second band to the first loop portion.

The above summary of the present invention is not intended to describe each disclosed embodiment of the present invention. The figures and detailed description that follow provide additional example embodiments and aspects of the present invention.

BRIEF DESCRIPTION OF THE DRAWINGS

Other aspects and advantages of the invention will become apparent upon reading the following detailed description and upon reference to the drawing in which.

Figure 1:
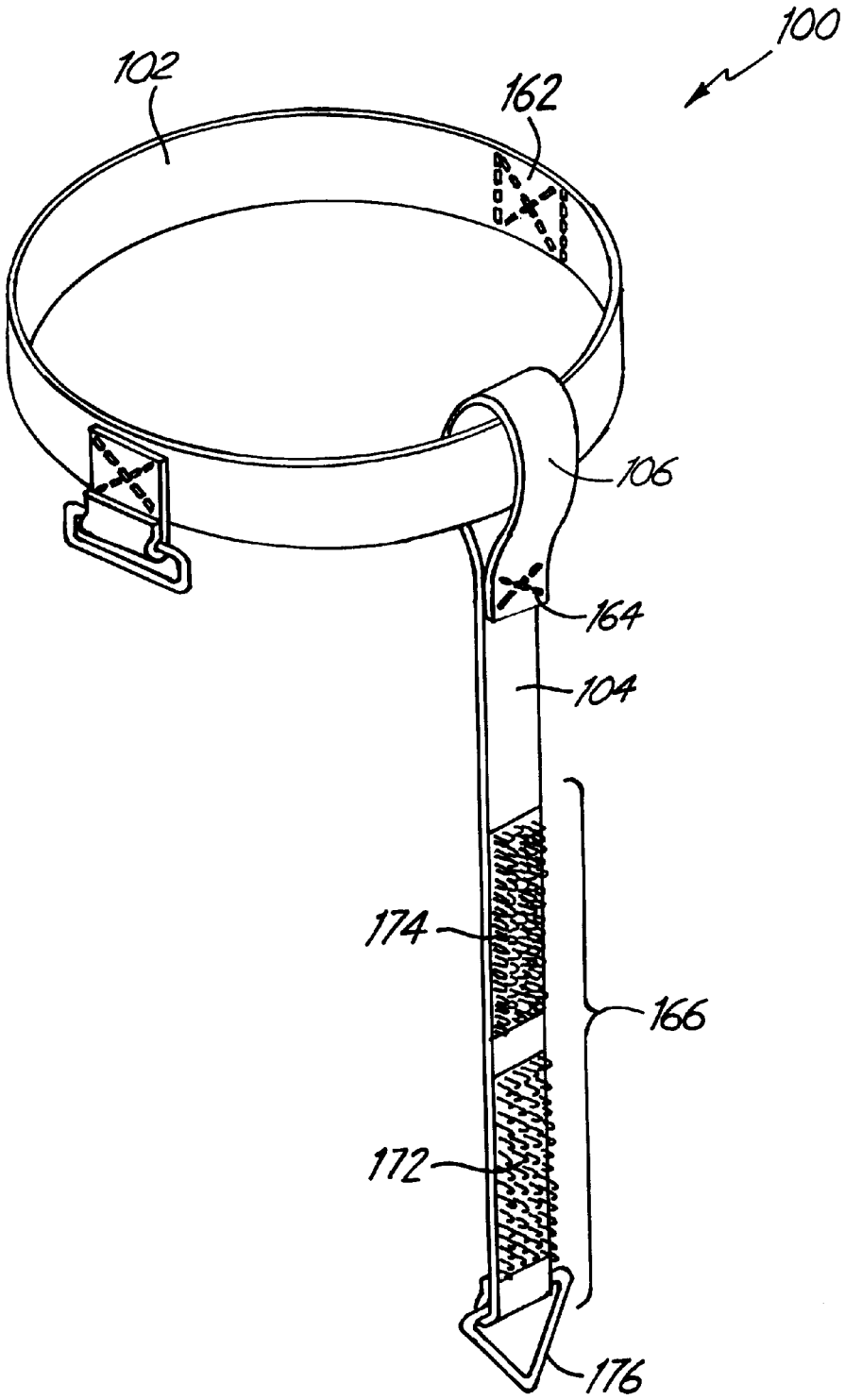
FIG. 1 is a perspective view of an example embodiment of an exercise arrangement according to the present invention.

While the invention is susceptible to various modifications and alternative forms, specific embodiments thereof have been shown by way of example in the drawings and will herein be described in detail. It should be understood, however, that the detailed description is not intended to limit the invention to the particular forms disclosed. On the contrary, the intention is to cover all modifications, equivalents, and alternatives falling within the spirit and scope of the invention as defined by the appended claims.

DETAILED DESCRIPTION

The present invention is believed to be applicable to a variety of arrangements for exercising with free-weights, and has been found to be particularly advantageous for use in performing abdominal and leg exercises with free-weights. While not so limited, the invention will be described in such an application.

FIG. 1 illustrates a first example embodiment of the invention. The exercise arrangement 100 includes a first band of material 102 formed into a loop and a second band of material 104 having one end 106 attached to the first band of material 102.

An example use of the exercise arrangement 100 involves use of a free-weight. The construction of the exercise arrangement 100 allows a person to select a desired size weight according to the person's capabilities. In addition, the arrangement 100 is constructed for optimal use according to the size of the person performing the exercise.

An example contemplated exercise involves laying on one's back on a level or inclined surface and repeatedly raising the feet above the surface while keeping the legs generally straight or slightly bent. The exercise arrangement provides a means for securing one or more free-weights to the feet in order to increase the intensity of the workout. Another example exercise is the leg extension in which a person sits on a surface and the legs from the knee down hang freely below the surface. The exercise involves repeatedly raising the lower portion of the legs such that both entire legs are generally straight. Other exercises include, for example, hanging from a bar and raising the knees to the chest, performing generally known dip exercises, and securing the arrangement 100 to a single leg and performing single leg lifts in various positions such as standing, lying on one's side, resting on one's knees and forearms, etc.

Figure 2:
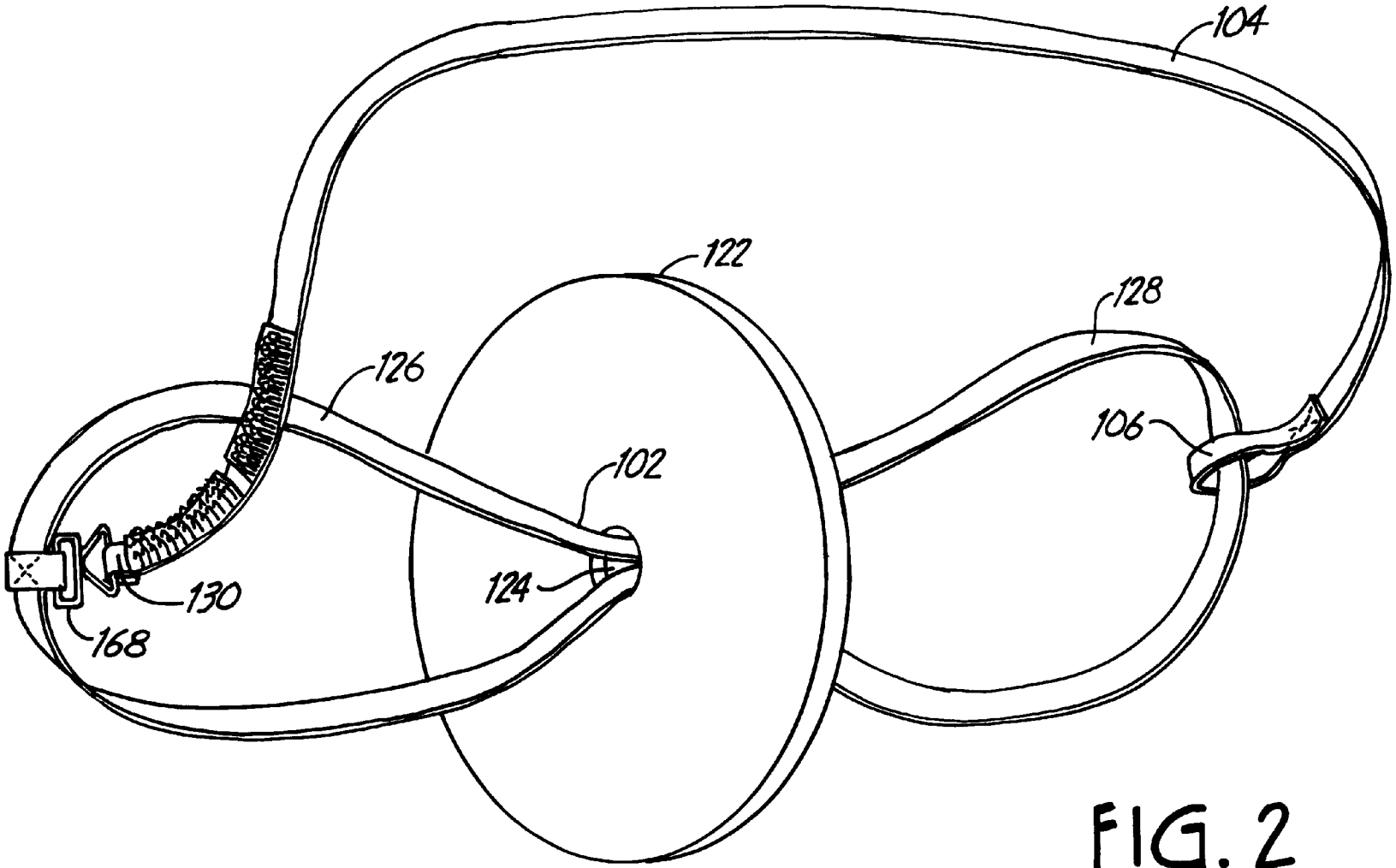
FIG. 2 is a perspective view of an example embodiment of the invention in which a free-weight is secured to the arrangement.

FIG. 2 is a perspective view that illustrates an example method for securing a free-weight with the arrangement 100 of FIG. 1. To secure the free-weight 122 to the feet, the first band of material 102 is threaded through an opening 124 in the free-weight such that a portion of the loop formed with the first band of material forms a first loop portion 126 on one side of the free-weight, and a second loop portion 128 is formed on the other side of the free-weight. The first loop portion 126 is sized to accommodate insertion of one foot, and the second loop portion 128 is sized to accommodate insertion of the other foot.

The second band of material 104 is used to secure the arrangement 100 to the feet to prevent the arrangement from slipping off during exercise. The first end 106 is arranged for attachment to the first band of material 102 at the second loop portion 128. The second band of material 104 is arranged to be wrapped around the back side of the legs, generally in the ankle area. The second end 130 of the second band of material 104 is then attached to the first loop portion 126 in a manner that provides a snug fit of the arrangement 100 to the lower area of the legs.

While loops 126 and 128 are shown as being of comparable size, it will be appreciated that the arrangement 100 can also be attached to a single foot. For example, one foot is inserted in loop 128, and loop 126 is substantially smaller than loop 128. The second end 130 is then secured to the loop portion 126 to prevent the weight 122 from falling off the first band 102.

Figure 3:
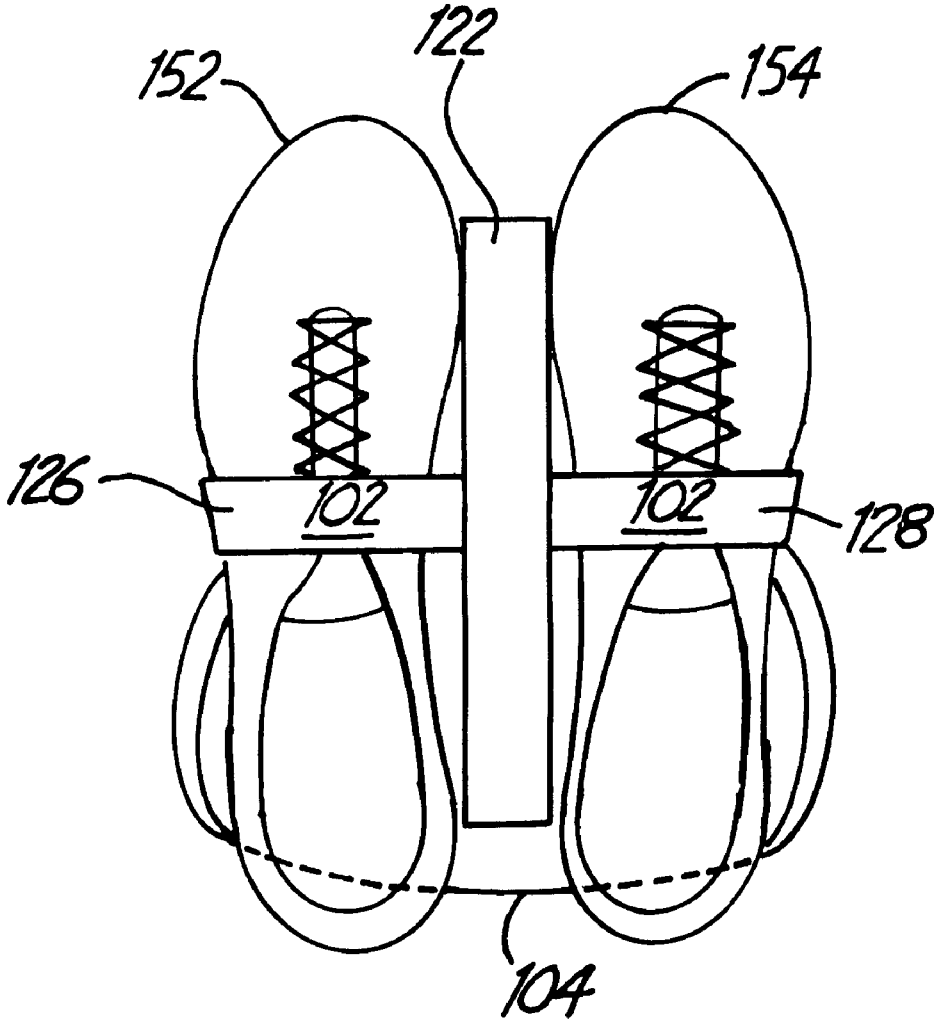
FIG. 3 is a top view of the example exercise arrangement.

FIG. 3 is a top view of the exercise arrangement 100 after having secured a free-weight 122. Left shoe 152 and right shoe 154 illustrate placement of the feet in the first and second loop portions 126 and 128, respectively. The second band of material 104 is wrapped around the back side of a person's legs (not shown) and attached to the first loop portion 126. It should be understood that the manner in which the second band is attached to the second loop portion 128 and attached to the first loop portion 126 accommodates various sizes of weights and bodies while preventing slipping and sliding of the arrangement 100 once secured to the feet.

Returning now to FIG. 1, the first band of material 102 and the second band of material 104 of the example arrangement 100 are constructed of like material. For example, in one embodiment, the material is heavy duty nylon capable of supporting a weight of approximately 100 to 150 pounds. Both bands 102 and 104 are approximately 2" wide. Those skilled in the art will recognize other suitable materials, such as cotton.

In the example arrangement 100, a loop is constructed from the first band of material 102 by sewing one end of the band to the other, as illustrated by seam 162. In alternative embodiments, the first band of material 102 may be constructed into a loop with, for example, a buckle arrangement or a metal band.

The perimeter of the loop constructed from the first band of material may be varied according the size of the person and the size and number of free-weights to be attached thereto. The size of the perimeter can be fixed or adjustable. For example, small, medium, large and extra large sizes can be constructed having perimeters ranging from about 16" to about 30'. An advantage to constructing the loop of the first band of material with a buckle arrangement is that the size of the loop is adjustable by the exerciser. It will also be appreciated that a smaller perimeter for the first band of material 102 permits attachment of the arrangement 100 to a foot for single leg exercises.

The second band of material 104 is attached to the loop of the first band of material 102 by wrapping an end portion 106 around the first band 102 and sewing part of the end portion 106 on the second band 104, as illustrated by seam 164. The loop formed by end portion 106 allows the second band 104 to slide on the loop of the first band 102 for optimal positioning of the band 104 once the feet have been placed in the first and second loop portions 126 and 128. In alternate embodiments, the second band of material 104 can be sewn directly to the first band 102 or attached by a ring.

In the illustrated embodiment, a plastic eyelet 168 is attached to the first band 102 at a location on the first loop portion 126. The second end portion 166 includes a hook fabric portion 172 and a loop fabric portion 174 sewn thereto. A plastic triangular ring is sewn to the end of the second band 104 for easily threading band 104 through the eyelet 168. The eyelet 168 and ring 176 may be made from metal or other suitable materials and formed into other shapes such as circles, ovals and other shapes in other alternate embodiments.

After having threaded the second band 104 part way through the eyelet 168, the end portion 168 is folded so that the hook fabric 172 contacts the loop fabric 174, thereby attaching the second band 104 to the first band 102. The hook-and-loop fabric portions 172 and 174 along with threading the second band 104 through the eyelet 168 effectively make the second band 104 of adjustable length. The adjustable length second band make the exercise arrangement suitable for a relatively wide range of sizes of people.

Other example embodiments of the invention are contemplated for securing the second end portion 166 of the second band 104 to the loop formed by the first band of material 102. For example, any one of a variety of buckle arrangements may be substituted for eyelet 168.

Figure 4:
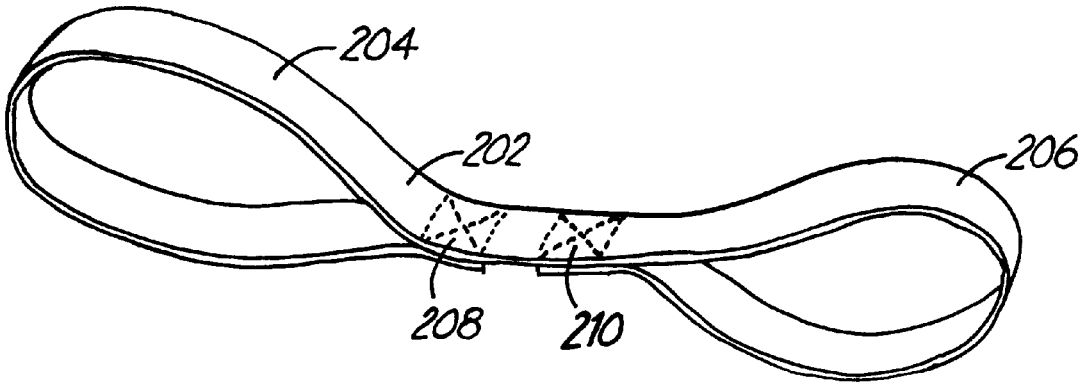
FIG. 4 is a perspective view of an alternate embodiment of a portion of the exercise arrangement of the present invention.

FIG. 4 is a perspective view of an alternate example embodiment in which a band of material 202 is formed into a first loop 204 and a second loop 206. The band 202 may be substituted for the first band of material 102 as shown in FIG. 1. The band 202 is distinguished from the band 102 in that two distinct loops 204 and 206 are constructed from the band 202. One end of the band 202 is sewn to the band to form loop 204, as illustrated by seam 208, and the other end of the band 202 is sewn to the band to form loop 206, as illustrated by seam 210.

Accordingly, the present invention provides, among other aspects, an apparatus and method for exercising with free-weights. Other aspects and embodiments of the present invention will be apparent to those skilled in the art from consideration of the specification and practice of the invention disclosed herein. It is intended that the specification and illustrated embodiments be considered as examples only, with a true scope and spirit of the invention being indicated by the following claims.

What is claimed is:

1. An exercise apparatus comprising:

a free-weight having a first side, a second side, and an opening extending therethough; and a first band of pliable material threaded through the opening of the free-weight and forming a continuous open loop having a first loop portion of the first band adjacent to the first side of the free-weight and a second loop portion of the first band adjacent to the second side of the free-weight, the first and second loop portions being sized to hold a portion of a person's body.

2. An exercise apparatus compraising:

a free-weight having a first side, a second side, and opening extending therethough;

a first band of pliable material threaded through the opening of the free-weight and forming a first loop portion of the first band adjacent to the first side of the free-weight and a second loop portion of the first band adjacent to the second side of the free-weight, the first and second loop portions being sized to hold a portion of a person's body;

a second band of pliable material having a first end and a second end, the first end attached to the first band of material and arranged to be attached to the first loop portion of the first band of material; and a receiving member attached to the second loop portion of the first band of material and arranged for attachment to the second end of the second band of material.

3. The exercise apparatus of claim 2, wherein the receiving member is arranged for adjustable attachment of the second band of material, whereby a length of the second band of material extending from attachment at the first loop portion to attachment at the second loop portion is adjustable.

4. The exercise apparatus of claim 2, wherein the first end of the second band of material is movably attached to the first band of material.

5. The exercise apparatus of claim 2, wherein:

the receiving member includes an eyelet arranged to receive the second end of the second band of material;

the second band of material includes a first portion of hook fabric and a second portion of loop fabric disposed toward the second end of the second band of material, the first and second portions arranged to attach one to the other when the second end of the second band of material is threaded through the eyelet.

6. The apparatus of claim 2, wherein the receiving member is a buckle arrangement.

7. An exercise apparatus comprising:

a free-weight having a first side, a second side, and a opening extending therethrough; and a first band of pliable material formed into a continuous open loop and threaded through the opening of the free-weight to form a first body engaging loop portion adjacent to the first side of the free-weight and a second body engaging loop portion adjacent to the second side of the free-weight.

8. The exercise apparatus of claim 7 and further comprising:

a second band of pliable material having a first end and a second end, the first end movably attached to the first band of material and arranged to be positioned on the first loop portion of the first band of material; and means for attaching the second end of the second band to the second loop portion of the first band of material.

9. An exercise apparatus of claim 7 and further comprising:

a second band of pliable material having a first end and a second end, the first end formed into a loop around the first band and arranged to be positioned on the first loop portion; and means for attaching the second end of the second band to the second loop portion of the first band of material.

10. A method for securing a free-weight to one or more of a person's feet for exercising therewith using a first band of pliable material constructed into a loop, a second band of pliable material having a first end attached to the first band of material and a second end, comprising:

threading the loop through the opening of the free-weight thereby forming a first loop portion adjacent to the first side of the free-weight and a second loop portion adjacent to the second side of the free-weight;

placing one foot into the first loop portion;

wrapping the second band around the back of at least one of the person's feet; and attaching the second end of the second band to the first loop portion.

11. The method of claim 10, further comprising placing the other foot into the second loop portion.

* * * * *